US006833226B2

(12) United States Patent
Takizawa et al.

(10) Patent No.: US 6,833,226 B2
(45) Date of Patent: Dec. 21, 2004

(54) ELECTROPHOTOGRAPHIC APPARATUS, PROCESS CARTRIDGE AND ELECTROPHOTOGRAPHIC PHOTOSENSITIVE MEMBER

(75) Inventors: Kumiko Takizawa, Saitama (JP); Hideki Ogawa, Ibaraki (JP); Wataru Kitamura, Chiba (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/106,213

(22) Filed: Mar. 27, 2002

(65) Prior Publication Data

US 2003/0039906 A1 Feb. 27, 2003

(30) Foreign Application Priority Data

Mar. 30, 2001 (JP) ..... 2001-099874
Mar. 30, 2001 (JP) ..... 2001-099876

(51) Int. Cl.[7] ..... G03G 5/047

(52) U.S. Cl. ..... 430/59.5; 430/59.4; 430/133; 430/134; 399/159

(58) Field of Search ..... 430/59.4, 59.5, 430/133, 134; 399/159

(56) References Cited

U.S. PATENT DOCUMENTS

| | | | | |
|---|---|---|---|---|
| 4,565,758 A | | 1/1986 | Tachiki et al. | 430/58 |
| 4,898,799 A | | 2/1990 | Fujimaki et al. | 430/59 |
| 5,132,197 A | | 7/1992 | Iuchi et al. | 430/76 |
| 5,194,354 A | | 3/1993 | Takai et al. | 430/58 |
| 5,284,728 A | * | 2/1994 | Murayama et al. | 430/58.45 |
| 5,389,480 A | * | 2/1995 | Ono et al. | 430/58.5 |
| 5,776,650 A | * | 7/1998 | Hashimoto et al. | 430/134 |
| 6,068,958 A | | 5/2000 | Yang et al. | 430/78 |

FOREIGN PATENT DOCUMENTS

| | | |
|---|---|---|
| EP | 1018672a | * 7/2000 |
| JP | 61-239248 | 10/1986 |
| JP | 62-67094 | 3/1987 |
| JP | 1-17066 | 1/1989 |
| JP | 3-54264 | 3/1991 |
| JP | 3-128973 | 5/1991 |

* cited by examiner

*Primary Examiner*—Christopher Rodee
(74) *Attorney, Agent, or Firm*—Fitzpatrick, Cella, Harper & Scinto

(57) ABSTRACT

In an electrophotographic apparatus including an electrophotographic photosensitive member around which a charger, an exposure device, a developing device and a transfer device are provided in this order and not having any charge elimination device between the transfer device and the charger the electrophotographic photosensitive member includes a support and a charge generation layer provided thereon containing a phthalocyanine compound and a charge transport layer, and has a light-area dark attenuation rate A and a dark-area dark attenuation rate B which satisfy the following expression (1):

$$1.0 \leqq \text{light-area dark attenuation rate } A/\text{dark-area dark attenuation rate } B \leqq 1.7 \quad (1).$$

11 Claims, 4 Drawing Sheets

ELECTROPHOTOGRAPHIC APPARATUS, PROCESS CARTRIDGE AND ELECTROPHOTOGRAPHIC PHOTOSENSITIVE MEMBER

BACKGROUND OF THE INVENTION

1. Field of the Invention

This invention relates to an electrophotographic apparatus, a process cartridge and an electrophotographic photosensitive member. More particularly, it relates to an electrophotographic apparatus having a specific image-forming means and an electrophotographic photosensitive member with specific physical properties, and a process cartridge and an electrophotographic photosensitive member which are used for such an electrophotographic apparatus.

2. Related Background Art

As electrophotographic photosensitive members used in copying machines, laser printers and so forth, there are many electrophotographic photosensitive members which utilize organic photoconductors because of the advantages that they have a high safety, are suited for mass production, and may require a low cost. In particular, multi-layer type electrophotographic photosensitive members having a charge generation layer and a charge transport layer enable improvement in sensitivity, and hence they prevail among organic electrophotographic photosensitive members available in recent years.

Meanwhile, in order to obtain images with a higher image quality, or in order to store inputted images or edit them at will, the formation of images is rapidly being digitized. When images are digitally formed, digital electrical signals are converted into light signals, which are then inputted to an electrophotographic photosensitive member. As light sources used therefor, lasers and LEDs (light-emitting diode) are chiefly used. At present, the light sources most widely used emit light with an oscillation wavelength of 790±20 nm. Accordingly, research has been conducted on electrophotographic photosensitive member materials having sufficient sensitivity in this wavelength region.

In particular, phthalocyanine compounds are widely studied and have been put into practical use as charge-generating materials, because many of them can be synthesized relatively easily and exhibit sensitivity in a long-wavelength region. Those showing especially high sensitivity include oxytitanium phthalocyanine, and those showing a variety of crystal forms have been studied as disclosed, e.g., in Japanese Patent Applications Laid-open No. 61-239248, No. 62-67094, No. 1-17066, No. 3-54264 and No. 3-128973.

However, in instances in which images are formed using the electrophotographic photosensitive member having a charge generation layer containing such a phthalocyanine compound as a charge-generating material and a charge transport layer, carriers generated in the charge generation layer upon exposure to light tend to remain therein because the phthalocyanine compound has high sensitivity, bringing about a disadvantage that any carriers having remained tend to cause variations of potential when images are formed on the next rotation of the electrophotographic photosensitive member. In particular, in the case of an electrophotographic apparatus not having any means for initialization (charge elimination or erasure), such as pre-exposure or the like, performed on the electrophotographic photosensitive member after a series of image formation steps, i.e., charging, exposure, development and transfer, have been completed and before it is charged for the next image formation operation (hereinafter also "eraseless electrophotographic apparatus"), what is called a "ghost", which is a phenomenon that an image formed on a previous one round of image formation of the electrophotographic photosensitive member comes to appear on the next image, has tended to occur when halftone images are reproduced.

SUMMARY OF THE INVENTION

An object of the present invention is to provide an electrophotographic apparatus which can enjoy high sensitivity, may cause no ghost at the initial stage and also when used repeatedly, and has superior image stability.

Another object of the present invention is to provide a process cartridge and an electrophotographic photosensitive member which are used for such an electrophotographic apparatus.

More specifically, the present invention is an electrophotographic apparatus comprising an electrophotographic photosensitive member around which a charging means, an exposure means, a developing means and a transfer means are provided in this order;

the electrophotographic apparatus not having any charge elimination means between the transfer means and the charging means; and the electrophotographic photosensitive member being an electrophotographic photosensitive member comprising a support and provided thereon a charge generation layer containing a phthalocyanine compound and a charge transport layer, and the electrophotographic photosensitive member having a light-area dark attenuation rate A and a dark-area dark attenuation rate B which satisfy the following expression (1):

$$1.0 \leqq \text{light-area dark attenuation rate } A/\text{dark-area dark attenuation rate } B \leqq 1.7 \quad (1);$$

A=(|surface potential immediately after second-round charging of electrophotographic photosensitive member regarding first-round surface potential as light-area potential|−|surface potential after leaving for one second in dark immediately after second-round charging of electrophotographic photosensitive member regarding first-round surface potential as light-area potential|)/|surface potential immediately after second-round charging of electrophotographic photosensitive member regarding first-round surface potential as light-area potential|; and B=(|surface potential immediately after second-round charging of electrophotographic photosensitive member regarding first-round surface potential as dark-area potential|−|surface potential after leaving for one second in dark immediately after second-round charging of electrophotographic photosensitive member regarding first-round surface potential as dark-area potential|)/|surface potential immediately after second-round charging of electrophotographic photosensitive member regarding first-round surface potential as dark-area potential|.

The present invention also provides a process cartridge and an electrophotographic photosensitive member which are used for the electrophotographic apparatus described above.

DESCRIPTION OF THE PREFERRED EMBODIMENTS

Figure 1:
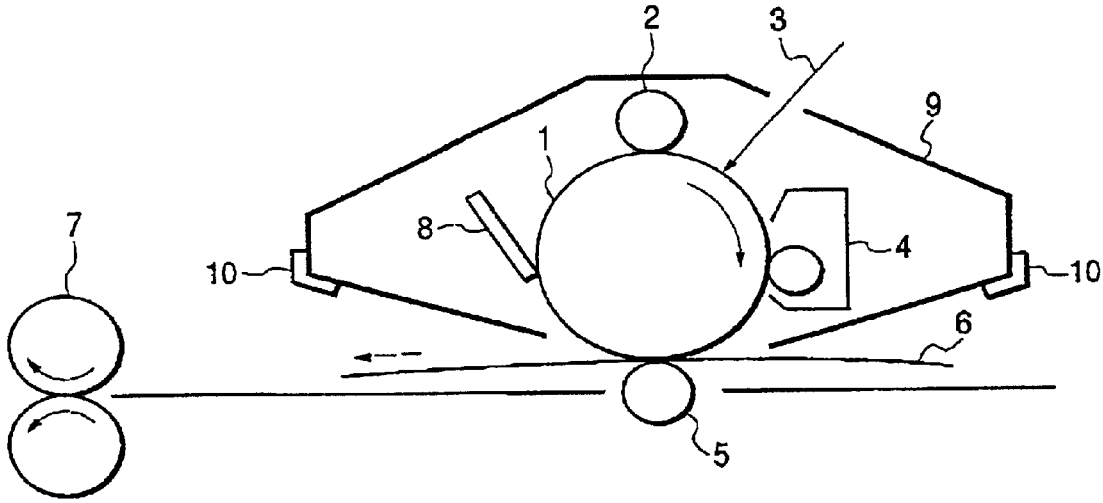
FIG. 1 schematically illustrates an example of the construction of an electrophotographic apparatus having a process cartridge having an electrophotographic photosensitive member according to the present invention.

The electrophotographic apparatus of the present invention has an electrophotographic photosensitive member around which a charging means, an exposure means, a developing means and a transfer means are provided in this order. The electrophotographic apparatus does not have any charge elimination means between the transfer means and the charging means, and the electrophotographic photosensitive member is an electrophotographic photosensitive member comprising a conductive support and provided thereon a charge generation layer containing a phthalocyanine compound and a charge transport layer.

As stated previously, such an electrophotographic apparatus tends to cause the phenomenon of a ghost. However, as a result of extensive studies, the present inventors have discovered that the use of an electrophotographic photosensitive member having a light-area dark attenuation rate A and a dark-area dark attenuation rate B which satisfy the following expression (1) makes the phenomenon of ghost not occur at the initial stage of course and also after its repeated use, i.e., the difference in halftone potential (hereinafter also "ghost potential") between exposed areas and unexposed areas at the time of a previous rotation can be made small at the time of next-time rotation.

$$1.0 \leqq \text{light-area dark attenuation rate } A/\text{dark-area dark attenuation rate } B \leqq 1.7 \quad (1);$$

A=(|surface potential immediately after second-round charging of electrophotographic photosensitive member regarding first-round surface potential as light-area potential|−|surface potential after leaving for one second in dark immediately after second-round charging of electrophotographic photosensitive member regarding first-round surface potential as light-area potential|)/|surface potential immediately after second-round charging of electrophotographic photosensitive member regarding first-round surface potential as light-area potential|; and B=(|surface potential immediately after second-round charging of electrophotographic photosensitive member regarding first-round surface potential as dark-area potential|−|surface potential after leaving for one second in dark immediately after second-round charging of electrophotographic photosensitive member regarding first-round surface potential as dark-area potential|)/|surface potential immediately after second-round charging of electrophotographic photosensitive member regarding first-round surface potential as dark-area potential|.

In the present invention, if the value of light-area dark attenuation rate A/dark-area dark attenuation rate B is less than 1.0 or more than 1.7, the history of an image formed on the previous rotation may appear on the next image as the phenomenon of a ghost when halftone images are reproduced. In the present invention, the value of light-area dark attenuation rate A/dark-area dark attenuation rate B may preferably be 1.0 or more and 1.4 or less.

In the present invention, the light-area dark attenuation rate A may be determined in the following way: Where an electrophotographic apparatus employing a reverse development method is used, an image having a solid-black area (whole surface exposure; light-area potential Vl) on the first round of the electrophotographic apparatus and a solid-white area (unexposed; dark-area, potential Vd) on the second round thereof is reproduced, and, immediately after the electrophotographic photosensitive member has been charged on the second round, the image formation process is turned OFF to measure the surface potential of the electrophotographic photosensitive member standing immediately after the image formation process is turned OFF and the surface potential of the electrophotographic photosensitive member standing after it has been kept in the dark for one second after the image formation process is turned OFF. Also, the dark-area dark attenuation rate B may be determined in the following way: An image having a solid-white area (unexposed, dark-area potential Vd) is reproduced, and, immediately after the electrophotographic photosensitive member has been charged on the second round, the image formation process is turned OFF to measure the surface potential of the electrophotographic photosensitive member standing immediately after the image formation process is turned OFF and the surface potential of the electrophotographic photosensitive member standing after it has been kept in dark for one second after the image formation process is turned OFF. Here, process conditions under which the surface potential is measured shall be the same as those for an electrophotographic apparatus to which the electrophotographic photosensitive member to be evaluated is actually mounted. Also, the "first round of the electrophotographic photosensitive member" herein termed refers to the first round starting from the start of what is called a substantial image formation process, i.e., an image formation process from which a process at the stage prior to image formation, such as pre-rotation, has been removed.

As a means for setting the relationship between the light-area dark attenuation rate A and the dark-area dark attenuation rate B within the range specified in the present invention, various means are available, such as the selection of the type of the charge transport layer material, the regulation of the layer thickness of the charge transport layer and the regulation of the mixing ratios of materials. In the present invention, from the viewpoint of making any influence on other aspects of the electrophotographic process as small as possible, it is preferable to form the charge generation layer to have a coating weight of 300 mg/m$^2$ or less, more preferably from 100 to 300 mg/m$^2$, and still more preferably from 130 to 220 mg/m$^2$. If it has a coating weight of more than 300 mg/m$^2$, the value of light-area dark attenuation rate A/dark-area dark attenuation rate B tends to become larger than 1.7. If the coating weight is too small, a ghost tends to occur particularly in an environment of low temperature and low humidity, and also sensitivity lowering and coating unevenness tend to occur.

The electrophotographic photosensitive member used in the present invention has a photosensitive layer on a support. Such a photosensitive layer has a charge generation layer and a charge transport layer preferably in this order from the support. Also, a protective layer may optionally be provided on the photosensitive layer in order to protect the surface of the electrophotographic photosensitive member.

As the support used in the present invention, any support may be used as long as it has a conductivity. It may include, e.g., supports made of metals such as aluminum, copper, chromium, nickel, zinc and stainless steel, or alloys of any of these, having been molded or shaped into drums, sheets or belts; those comprised of aluminum or copper metal (or alloy) foil laminated to plastic films; those comprised of aluminum, indium oxide, tin oxide or the like deposited on plastic films; and those comprised of metals, plastic films, papers or the like provided thereon with conductive layers formed by coating conductive materials alone or together with binder resins.

In the case of laser beam printers or the like in which the exposure light is laser light, the support may be provided thereon with a conductive layer in order to prevent interference fringes from being caused by scattering or to cover any scratches of the support. This layer may be formed using a fluid prepared by dispersing a conductive powder such as carbon black or metal particles in a binder resin. The conductive layer may preferably have a layer thickness of from 5 to 40 $\mu$m, and particularly preferably from 10 to 30 $\mu$m.

The charge generation layer of the electrophotographic photosensitive member of the present invention contains a phthalocyanine compound as a charge-generating material. The phthalocyanine compound to be used may include metal-free phthalocyanine, and phthalocyanines in which any of metals, such as titanium, gallium, zinc, copper, and vanadium or oxides or chlorides thereof have coordinated. Of these, from the viewpoint of having a higher sensitivity, oxytitanium phthalocyanines are particularly preferred.

Such oxytitanium phthalocyanines are represented by the following structural formula:

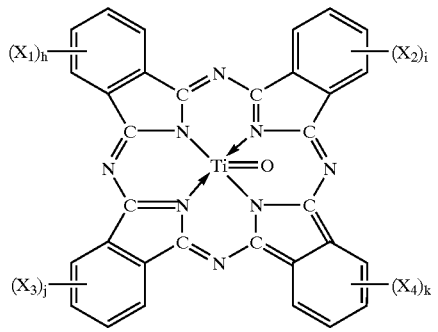

wherein $X_1$, $X_2$, $X_3$ and $X_4$ each represent Cl or Br, and h, i, j and k are each an integer of 0 to 4.

In the present invention, the oxytitanium phthalocyanine may further preferably be one having strong peaks at Braggs's angles (2θ±0.2°) of 9.0°, 14.2°, 23.9° and 27.1°, or 9.6° and 27.3°, in a CuKα characteristic X-ray diffraction.

In the charge generation layer, as long as the remarkable effect of the present invention can be attained, a charge-generating material other than the phthalocyanine compound may be used in combination and any additive may also be added thereto.

The charge generation layer may be formed by coating a dispersion prepared by dispersing the phthalocyanine compound and a binder resin together with a dispersing solvent, followed by drying. The binder resin used may include, e.g., polyvinyl butyral resins, polyester resins, acrylic resins, phenoxy resins, polycarbonate resins, polyvinyl acetal resins, polystyrene resins and polyarylate resins. From the viewpoint of stability of dispersions, polyvinyl butyral resins are preferred. In the charge generation layer, the phthalocyanine compound and the binder resin may be in a weight ratio proportion ranging from 10:1 to 1:5, and preferably from 5:1 to 1:1.

The dispersing solvent may include organic solvents as exemplified by ether type solvents such as tetrahydrofuran, n-propyl ether, n-butyl ether and 1,4-dioxane, alcohol type solvents such as methanol, ethanol and propanol, and ketone type solvents such as acetone, methyl ethyl ketone and cyclohexanone, as being preferable in view of dispersion properties and the stability of the crystal form of the phthalocyanine compound.

As described previously, as a means for setting the relationship between the light-area dark attenuation rate A and the dark-area dark attenuation rate B within the range specified in the present invention, it is preferable to form the charge generation layer has a coating weight (weight of charge generation layer=solid-content weight of charge generation layer coating fluid) of 300 mg/m$^2$ or less, particularly from 100 to 300 mg/m$^2$, and more particularly from 130 to 220 mg/m$^2$. If it has a coating weight of more than 300 mg/m$^2$, it may be difficult to achieve the preferable dark attenuation rate. If, on the other hand, it has a coating weight of less than 100 mg/m$^2$, not only may it be difficult to achieve the preferable dark attenuation rate, but also it may be difficult to perform uniform coating.

In the present invention, water may more preferably further be mixed in the above organic solvent. The amount of water may preferably be from 1% by weight to less than 3% by weight based on the total weight of the coating fluid for the charge generation layer. If the amount of water is less than 1% by weight, it may not only be difficult to achieve the preferable dark attenuation rate, but also it may be difficult to attain the effect on sensitivity characteristics. If, on the other hand, it is in an amount of 3% by weight or more, not only may it be difficult to achieve the preferable dark attenuation rate, but also faulty coating, such as whitening or unevenness, tends to occur during the manufacture. Moreover, the agglomeration of the charge-generating material tends to occur in the coating fluid, and spot-like image defects caused by it also tends to occur.

In addition, taking account of the stability of the coating fluid, the amount of water may preferably be from 1% by weight to less than 130% by weight, and particularly preferably from 1% by weight to less than 100% by weight, based on the weight of the phthalocyanine compound.

From the viewpoint of being mixed with the water, the organic solvent may preferably be selected from tetrahydrofuran and cyclohexanone.

A means for dispersing the charge-generating material in the organic solvent together with the binder resin may include a paint shaker, a sand mill, a ball mill, a homogenizer, an ultrasonic dispersion machine and a liquid-impact type high-speed dispersion machine.

The charge generation layer may also preferably-have a thickness of 5 $\mu$m or less, and particularly preferably from 0.1 to 2 $\mu$m, which depends on its coating weight.

The charge transport layer may be formed by coating a coating solution prepared by dissolving a charge-transporting material in a binder resin, followed by drying. The charge-transporting material may include polycyclic aromatic compounds having a biphenylene, anthracene, pyrene, phenanthrene or the like structure in the backbone chain or side chain; nitrogen-containing cyclic compounds such as indole, carbazole, oxadiazole and pyrazoline; and hydrazone compounds, styryl compounds, and triarylarnine compounds.

The binder resin may include, e.g., polyester resins, polycarbonate resins, polyarylate resins, polystyrene resins and polymethacrylate resins.

The charge transport layer may preferably have a thickness of 5 to 40 $\mu$m, and particularly preferably from 10 to 30 $\mu$m.

In the present invention, a subbing layer having the function of a barrier and the function of adhesion may also be provided between the support and the photosensitive layer. The subbing layer may be formed by coating casein, polyvinyl alcohol, nitrocellulose, an ethylene-acrylic acid copolymer, an alcohol-soluble amide, polyurethane or gelatin, followed by drying.

The subbing layer may preferably have a thickness of from 0.1 to 3 $\mu$m.

As coating processes for coating the coating fluids for the respective layers described above, they may include, but without limitation, dip coating, spray coating, spinner coating, roller coating, wire bar coating and blade coating.

The electrophotographic photosensitive member of the present invention may be not only usable in electrophotographic copying machines, but also widely applicable in the fields where electrophotography is applied, e.g., laser beam printers, CRT printers, LED printers, facsimile machines, liquid-crystal printers and laser beam engravers.

As described previously, the support may have the shape of any of a drum, a sheet or a belt, and may preferably have a shape most suited for the electrophotographic apparatus for which it is to be used.

FIG. 1 schematically illustrates the construction of an electrophotographic apparatus provided with a process cartridge having the electrophotographic photosensitive member of the present invention.

In FIG. 1, reference numeral 1 denotes a drum type electrophotographic photosensitive member of the present invention, which is rotatingly driven around an axis in the direction of an arrow at a stated peripheral speed. The electrophotographic photosensitive member 1 is, in the course of its rotation, uniformly electrostatically charged on its periphery to a positive or negative, given potential through a primary charging means 2. The electrophotographic photosensitive member thus charged is then exposed to light 3, the intensity of which has been modified correspondingly to time-sequential electrical digital image signals of the intended image information outputted from an exposure means (not shown), such as exposure or laser beam scanning exposure means. In this way, electrostatic latent images corresponding to the intended image information are successively formed on the periphery of the electrophotographic photosensitive member 1.

The electrostatic latent images thus formed are developed with a toner by the operation of a developing means 4. The resulting toner images formed on the surface of the electrophotographic photosensitive member 1 are then successively transferred by the operation of a transfer means 5, to the surface of a transfer medium 6 fed from a paper feed section (not shown) to the part between the electrophotographic photosensitive member 1 and the transfer means 5 in a manner synchronized with the rotation of the electrophotographic photosensitive member 1.

The transfer medium 6 on which the images have been transferred is separated from the surface of the electrophotographic photosensitive member, is led to an image fixing means 7, where the images are fixed, and is then printed out of the apparatus as an image-formed material (a print or a copy).

The surface of the electrophotographic photosensitive member 1 from which images have been transferred is brought to a position for removal of the toner remaining after the transfer, through a cleaning means 8. Thus, the electrophotographic photosensitive member is cleaned on its surface and then repeatedly used for the formation of images. As to the cleaning means 8, without being independently provided, the developing means 5 may serve also as a cleaning means at the time of the next rotation.

In the present invention, a plurality of components among the constituents such as the above electrophotographic photosensitive member 1, the primary charging means 2, the developing means 4 and the cleaning means 8 may be so held in a housing as to be integrally joined as a process cartridge so that the process cartridge is detachably mountable to the body of the electrophotographic apparatus, such as a copying machine or a laser beam printer. For example, at least one of the primary charging means 2, the developing means 4 and the cleaning means 8 may integrally be supported in a cartridge together with the electrophotographic photosensitive member 1 to form a process cartridge 9 that is detachably mountable to the body of the apparatus through a guide means 10, such as rails provided in the body of the apparatus.

In the case when the electrophotographic apparatus is used as a copying machine or a printer, the exposure light 3 is light reflected from, or transmitted through, an original, or light irradiating the electrophotographic photosensitive member 1 by the scanning of a laser beam, the driving of an LED array or the driving of a liquid crystal shutter array according to signals obtained by reading an original through a sensor and converting the information into signals.

The present invention is described below in greater detail by the following Examples. In the following Examples, "part(s)" indicates "part(s) by weight".

EXAMPLE 1

50 parts of titanium oxide powder coated with tin oxide containing 10% of antimony oxide, 25 parts of resol type phenolic resin, 30 parts of methoxypropanol, 30 parts of methanol and 0.002 part of silicone oil (a polydimethylsiloxane-polyoxyalkylene copolymer; weight average molecular weight: 3,000) were put into a dispersion for 2 hours by means of a sand mill using glass beads of 1 mm in diameter to prepare a coating fluid for the conductive layer. This coating fluid was coated on an aluminum cylinder of 24 mm in diameter and 246 mm in length by dip coating, followed by drying at 140° C. for 30 minutes to form a conductive layer with a layer thickness of 20 $\mu$m.

On the conductive layer, a solution prepared by dissolving 10 parts of polyamide resin (trade name: AMILAN CM-8000; available from Toray Industries, Inc.) in 200 parts of methanol was coated by dip coating, followed by drying at 90° C. for 10 minutes to form a subbing layer with a layer thickness of 0.7 $\mu$m.

Figure 2:
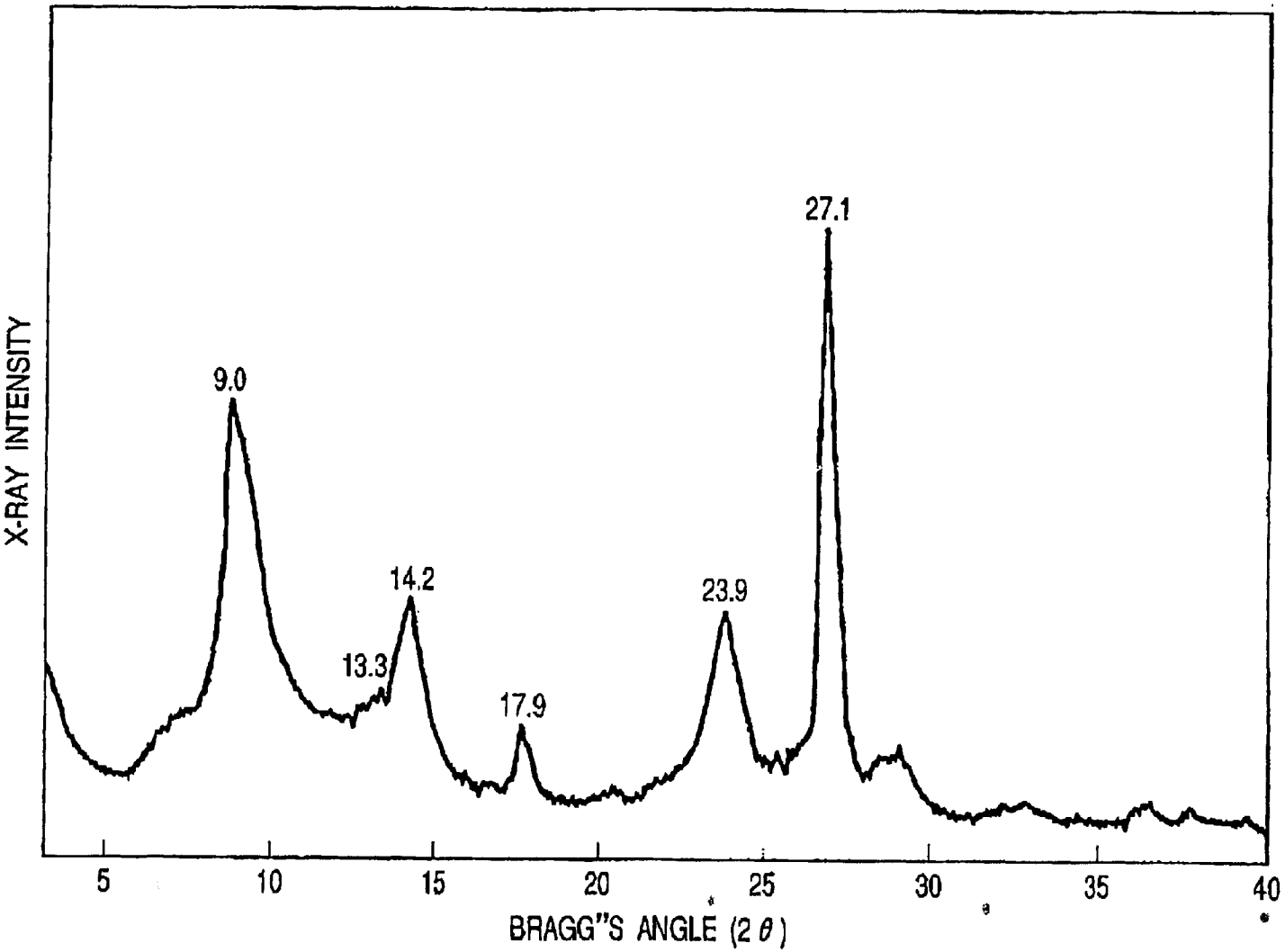
FIG. 2 is a CuKα characteristic X-ray diffraction pattern of an oxytitanium phthalocyanine used in Example 1.

Next, as a charge-generating material, 10 parts of oxytitanium phthalocyanine represented by the following structural formula:

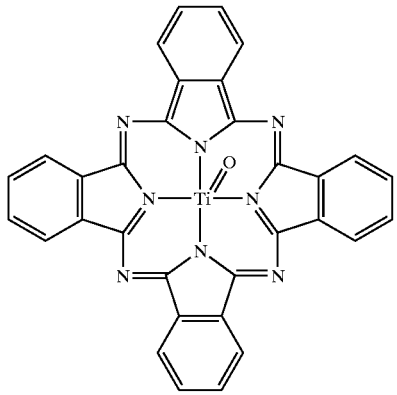

and having strong peaks at Bragg's angles (2θ±0.2°) of 9.0°, 14.2°, 23.9° and 27.1° in a CuKα characteristic X-ray diffraction as shown in FIG. 2, 6.7 parts of polyvinyl butyral (trade name: BX-1; available from Sekisui Chemical Co., Ltd.), 285 parts of tetrahydrofuran and 8.5 parts of distilled water were all put into a dispersion for 4 hours by means of a sand mill using 400 parts of glass beads of 1 mm in diameter, to which dispersion 400 parts of cyclohexanone was added to prepare a coating fluid. This coating fluid was coated on the above subbing layer by dip coating, followed by drying at 90° C. for 10 minutes to form a charge generation layer having a dried coating weight of 150 mg/m$^2$.

Next, 9 parts of an amine compound represented by the following structural formula:

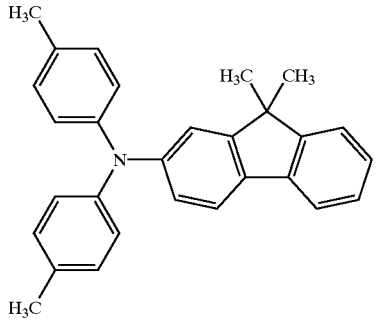

1 part of an amine compound represented by the following structural formula:

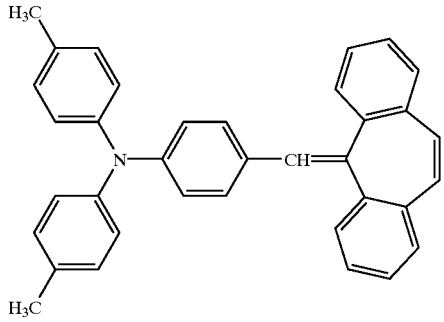

and 10 parts of bisphenol-Z polycarbonate (trade name: Z-200; available from Mitsubishi Gas Chemical Company, Inc.) were dissolved in a mixed solvent of 40 parts of dichloromethane and 60 parts of monochlorobenzene. The solution thus formed was coated on the charge generation layer by dip coating, followed by hot-air drying at 105° C. for 1 hour to form a charge transport layer with a layer thickness of 25 μm. Thus, an electrophotographic photosensitive member was produced.

The dark attenuation characteristics of the electrophotographic photosensitive member thus produced were evaluated by the use of a reverse development type laser beam printer (trade name: LASERJET 1100, manufactured by Hewlett-Packard Co.), an eraseless electrophotographic apparatus, so setting the dark-area potential (Vd) as to be −580 V and the light-area potential (Vl) to be −150 V. As exposure light, laser light with a wavelength of 780 nm was used.

The amount of light that was necessary for the surface potential of the electrophotographic photosensitive member to be set from the dark-area potential into the light-area potential was regarded as the sensitivity.

An evaluation of ghosts was made in the following way: The above laser beam printer was so used that an A4 image having a solid-black area (whole surface exposure; light-area potential Vl) and a solid-white area (unexposed; dark-area potential Vd) at the part (of about 75 mm long) corresponding to the first round of the electrophotographic photosensitive member and having a halftone area on the second and subsequent rounds thereof was reproduced. Then, the surface potential of the electrophotographic photosensitive member at its second-round halftone image area was measured at the initial stage and after continuous image reproduction on 1,000 sheets, where the difference in potential at the second-round halftone image area, between the part corresponding to the solid-black area on the first round and the part corresponding to the solid-white area on the first round was determined. It follows that, the greater the difference in potential, the more seriously the phenomenon of ghost has occurred.

The results of these are shown in Table 1.

EXAMPLE 2

An electrophotographic photosensitive member was produced and evaluated in the same manner as in Example 1 except that the charge generation layer was formed to have a coating weight of 220 mg/m$^2$. The results are shown in Table 1.

EXAMPLE 3

An electrophotographic photosensitive member was produced and evaluated in the same manner as in Example 1 except that the charge generation layer was formed to have a coating weight of 300 mg/m$^2$. The results are shown in Table 1.

EXAMPLE 4

An electrophotographic photosensitive member was produced and evaluated in the same manner as in Example 1 except that the charge generation layer was formed using the binder resin in an amount of 5 parts and formed to have a coating weight of 110 mg/m$^2$. The results are shown in Table 1.

COMPARATIVE EXAMPLE 1

An electrophotographic photosensitive member was produced and evaluated in the same manner as in Example 1 except that the charge generation layer was formed to have a coating weight of 400 mg/m$^2$. The results are shown in Table 1.

COMPARATIVE EXAMPLE 2

An electrophotographic photosensitive member was produced and evaluated in the same manner as in Example 1 except that, as the charge-generating material, 10 parts of oxytitanium phthalocyanine having strong peaks at Bragg's angles (2θ±0.2°) of 9.0°, 14.2°, 23.9° and 27.1° in a CuKα characteristic X-ray diffraction (the above compound), 6.7 parts of polyvinyl butyral (trade name: BX-1; available from Sekisui Chemical Co., Ltd.) and 300 parts of cyclohexanone were put into a dispersion for 4 hours by means of a sand mill using 400 parts of glass beads of 1 mm in diameter, to which dispersion 500 parts of ethyl acetate was added to prepare a coating fluid, which was then coated to have a coating weight of 310 mg/m$^2$. The results are shown in Table 1.

COMPARATIVE EXAMPLE 3

An electrophotographic photosensitive member was produced and evaluated in the same manner as in Example 1 except that the charge-generating material was changed to a phthalocyanine represented by the following structural formula:

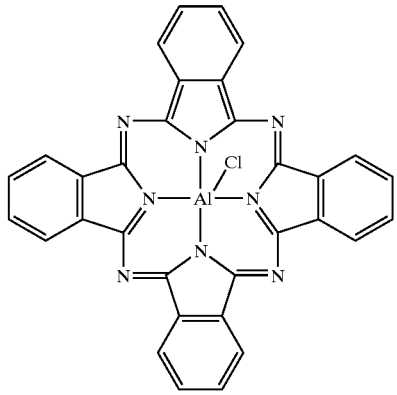

and the charge generation layer was formed to have a coating weight of 400 mg/m$^2$. The results are shown in Table 1.

COMPARATIVE EXAMPLE 4

Figure 3:
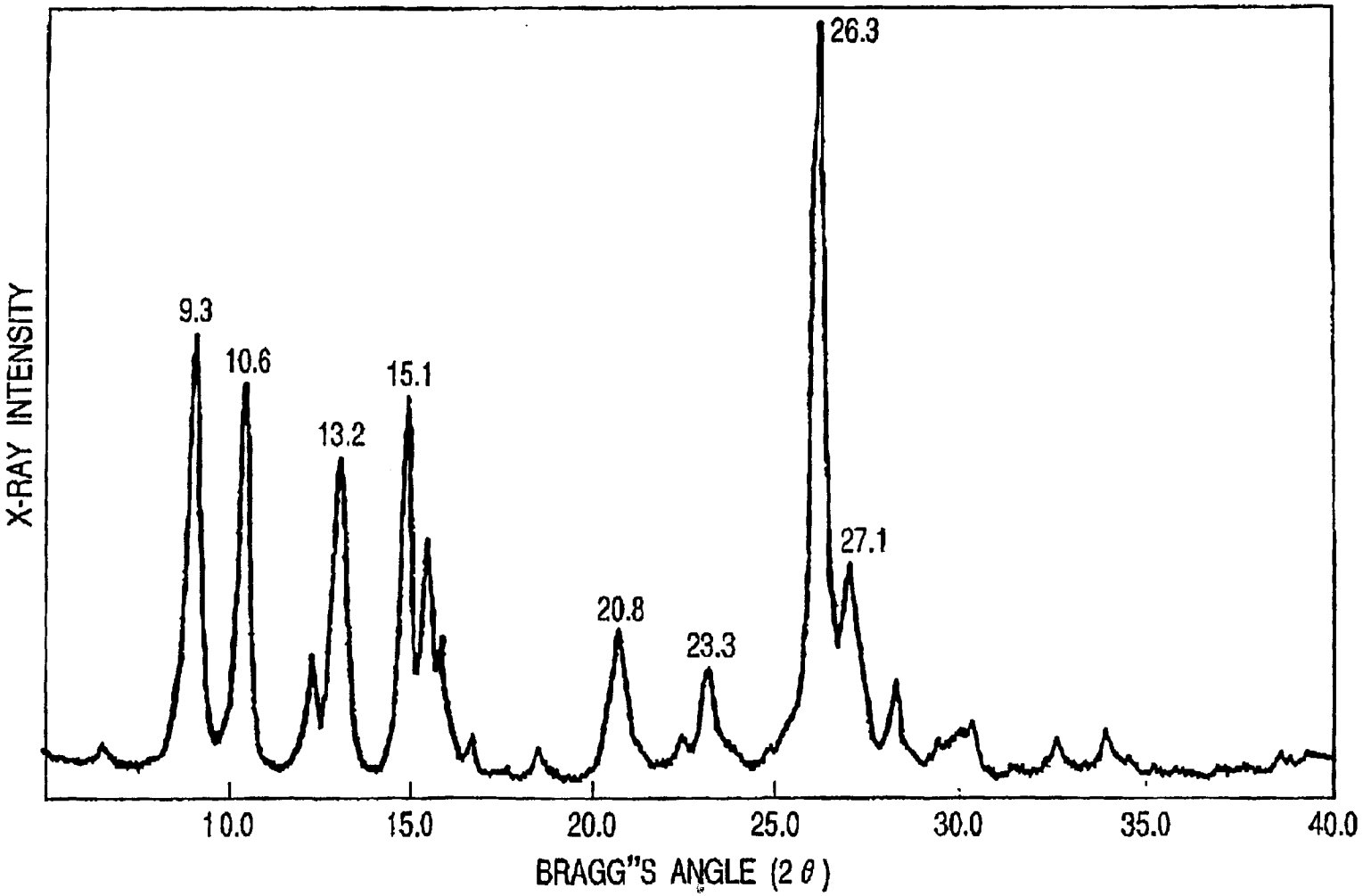
FIG. 3 is a CuKα characteristic X-ray diffraction pattern of an oxytitanium phthalocyanine used in Comparative Example 4.

An electrophotographic photosensitive member was produced and evaluated in the same manner as in Example 1 except that the oxytitanium phthalocyanine was changed to one having a crystal form of a CuKα characteristic X-ray diffraction shown in FIG. 3 and the charge generation layer was formed in a coating weight of 400 mg/m$^2$. The results are shown in Table 1.

COMPARATIVE EXAMPLE 5

An electrophotographic photosensitive member was produced and evaluated in the same manner as in Comparative Example 2 except that the charge generation layer was formed to have a coating weight of 300 mg/m$^2$. The results are shown in Table 1.

TABLE 1

| | A | | B | | | | Water content in | | | Ghost | |
|---|---|---|---|---|---|---|---|---|---|---|---|
| | Immediately after charging (−V) | 1 sec. after charging (−V) | Immediately after charging (−V) | 1 sec. after charging (−V) | A/B | Coating weight (mg/m$^2$) | coating fluid (wt. %) | Water/phthalocyanine (wt. %) | Sensitivity (mJ/m$^2$) | Initial stage (V) | After 1,000 sheets (V) |
| Example: | | | | | | | | | | | |
| 1 | 571 | 565 | 580 | 575 | 1.2 | 150 | 1.2 | 85 | 2.5 | 0 | 0 |
| 2 | 570 | 563 | 580 | 575 | 1.4 | 220 | 1.2 | 85 | 2.3 | 0 | 3 |
| 3 | 570 | 562 | 580 | 575 | 1.6 | 300 | 1.2 | 85 | 2.2 | 0 | 5 |
| 4 | 570 | 565 | 580 | 575 | 1.0 | 110 | 1.2 | 85 | 2.0 | 0 | 0 |
| Comparative Example: | | | | | | | | | | | |
| 1 | 569 | 558 | 579 | 575 | 2.8 | 400 | 1.2 | 85 | 2.0 | 10 | 15 |
| 2 | 570 | 557 | 580 | 576 | 3.3 | 310 | — | — | 2.4 | 15 | 25 |
| 3 | 569 | 534 | 579 | 565 | 2.5 | 400 | 1.2 | 85 | 17 | 13 | 20 |
| 4 | 569 | 560 | 579 | 575 | 2.3 | 400 | 1.2 | 85 | 15 | 10 | 20 |
| 5 | 570 | 558 | 580 | 576 | 3.1 | 300 | — | — | 2.5 | 15 | 25 |

EXAMPLE 5

Using an aluminum cylinder of 24 mm in diameter and 246 mm in length as a support, a coating fluid constituted of the materials shown below was coated thereon by dip coating, followed by drying at 140° C. for 30 minutes to form a conductive layer with a layer thickness of 15 μm.

| | |
|---|---|
| Conductive pigment: $SnO_2$-coated barium sulfatte | 10 parts |
| Resistance-controlling pigment: titanium oxide | 2 parts |
| Binder resin: phenolic resin | 6 parts |
| Leveling material: silicone oil | 0.001 part |
| Solvent: methanol/methoxypropanol(0.2/0.8) | 20 part |

Next, on this layer, a solution prepared by dissolving 3 parts of N-methoxymethylated nylon and 3 parts of a copolymer nylon in a mixed solvent of 65 parts of methanol and 30 parts of n-butanol was coated by dip coating, followed by drying at 100° C. for 15 minutes to form a subbing layer with a layer thickness of 0.5 μm.

Next, 10 parts of oxytitanium phthalocyanine having strong peaks at Bragg's angles (2θ±0.2°) of 9.0°, 14.2°, 23.9° and 27.1° in a CuKα characteristic X-ray diffraction (X-ray diffraction pattern: FIG. 2), 8 parts of polyvinyl butyral (trade name: S-LEC BM2; available from Sekisui Chemical Co., Ltd.) and 300 parts of a 97:3 mixed solvent of tetrahydrofuran and water were put into a dispersion for 4 hours by means of a sand mill using 400 parts of glass beads of 1 mm in diameter, followed by the further addition of 400 parts of cyclohexane and 150 parts of a 97:3 mixed solvent of tetrahydrofuran and water to prepare a charge generation layer coating fluid. The water content of this coating fluid was measured to find that it was 1.6% by weight. Incidentally, the water content was measured with a Karl Fischer water content meter (AQV-200; manufactured by Hiranuma Sangyo K. K.). This coating fluid was coated on the subbing layer by dip coating, followed by drying at 90° C. for 10 minutes to form a charge generation layer in a dried coating weight of 300 mg/m$^2$. The coating film thus formed was visually observed, where any coating defects were not seen.

Next, 8 parts of an amine compound represented by the following structural formula:

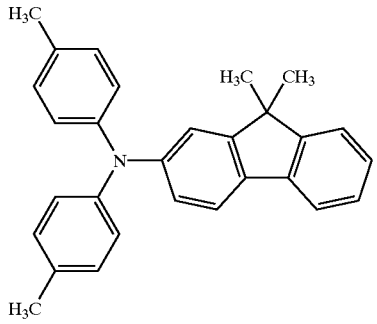

1 part of an amine compound represented by the following structural formula:

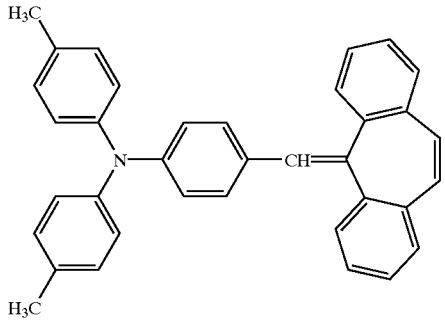

and 10 parts of bisphenol-Z polycarbonate (trade name: Z-200; available from Mitsubishi Gas Chemical Company, Inc.) were dissolved in a mixed solvent of 70 parts of monochlorobenzene and 30 parts of dichloromethane. The coating solution thus formed was coated on the charge generation layer by dip coating, followed by drying at 110° C. for 1 hour to form a charge transport layer with a layer thickness of 24 μm. Thus, an electrophotographic photosensitive member was produced.

The electrophotographic photosensitive member thus produced was evaluated on its dark attenuation characteristics, its sensitivity, and its ghost images in the same manner as in Example 1.

The results of these are shown in Table 2.

EXAMPLE 6

Figure 4:
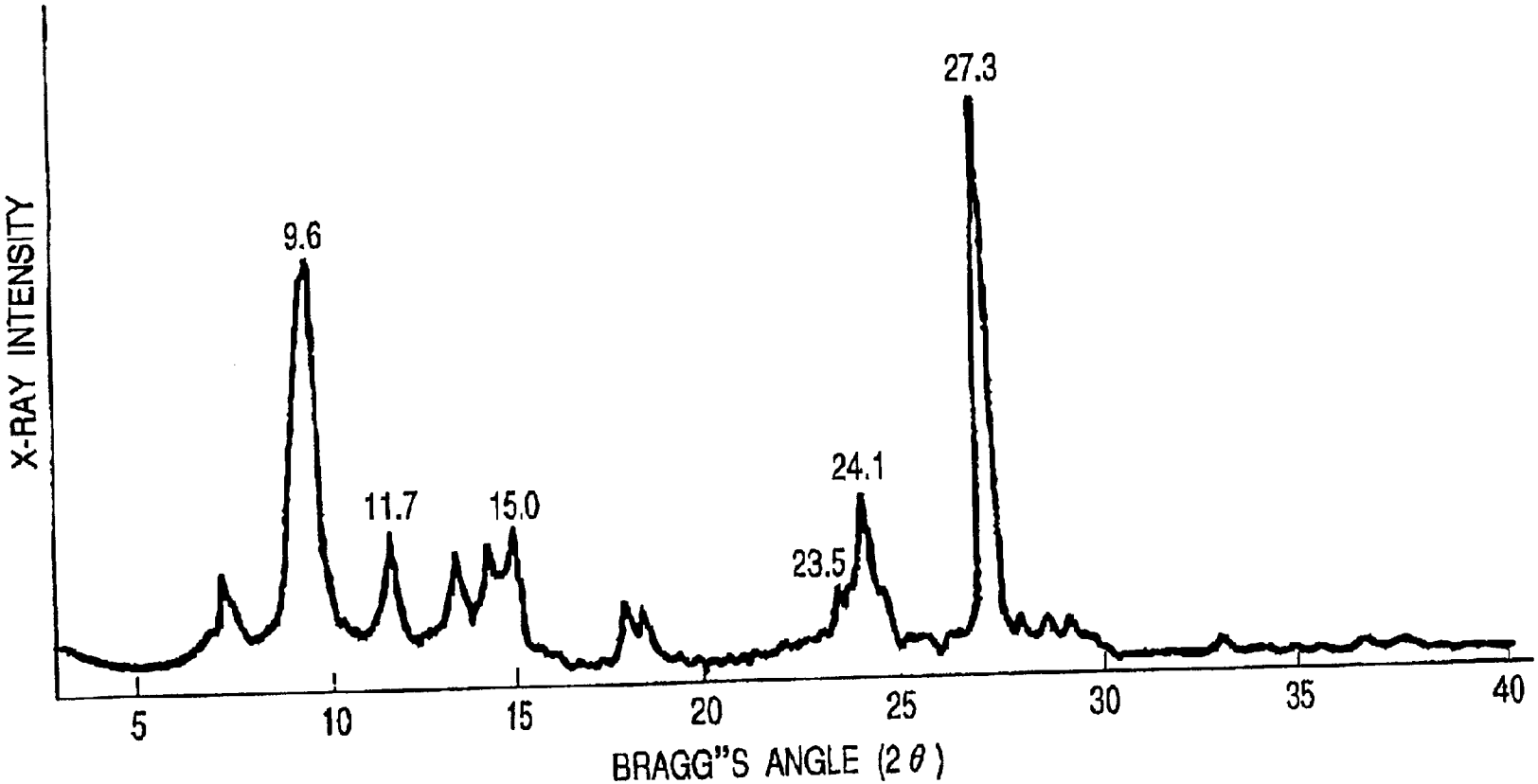
FIG. 4 is a CuKα characteristic X-ray diffraction pattern of an oxytitahium phthalocyanine used in Example 6.

An electrophotographic photosensitive member was produced and evaluated in the same manner as in Example 5 except that oxytitanium phthalocyanine having strong peaks at Bragg's angles (2θ±0.2°) of 9.6° and 27.3° in a CuKα characteristic X-ray diffraction (X-ray diffraction pattern: FIG. 4) was used as the charge-generating material. The results are shown in Table 2.

EXAMPLE 7

An electrophotographic photosensitive member was produced and evaluated in the same manner as in Example 5 except that 12 parts of water was further added to the charge generation layer coating fluid. Here, the water content in the coating fluid was 2.9% by weight. The results are shown in Table 2.

EXAMPLE 8

An electrophotographic photosensitive member was produced and evaluated in the same manner as in Example 5 except that, in place of the 97:3 mixed solvent of tetrahydrofuran and water, a 98:2 mixed solvent of tetrahydrofuran and water was used to prepare the charge generation layer coating fluid. Here, the water content in the coating fluid was 1.0% by weight. The results are shown in Table 2.

EXAMPLE 9

An electrophotographic photosensitive member was produced and evaluated in the same manner as in Example 5 except that 300 parts of cyclohexanone only was used as the dispersing solvent and 550 parts of a 96:4 mixed solvent of tetrahydrofuran and water only was added after dispersion to prepare the charge generation layer coating fluid. Here, the water content in the coating fluid was 2.5% by weight. The results are shown in Table 2.

COMPARATIVE EXAMPLE 6

An electrophotographic photosensitive member was produced and evaluated in the same manner as in Example 9 except that the solvent added after dispersion was changed to 550 parts of ethyl acetate only. The results are shown in Table 2.

COMPARATIVE EXAMPLE 7

An electrophotographic photosensitive member was produced and evaluated in the same manner as in Comparative Example 6 except that the oxytitanium phthalocyanine used in Example 6 was used as the charge-generating material. The results are shown in Table 2.

COMPARATIVE EXAMPLE 8

An electrophotographic photosensitive member was produced and evaluated in the same manner as in Example 9 except that, in place of the 96:4 mixed solvent of tetrahydrofuran and water, a 99:1 mixed solvent of tetrahydrofuran and water was used to prepare the charge generation layer coating fluid. Here, the water content in the coating fluid was 0.6% by weight. The results are shown in Table 2.

EXAMPLE 10

An electrophotographic photosensitive member was produced and evaluated in the same manner as in Example 7 except that the charge generation layer was formed to have a coating weight of 110 mg/m$^2$. Here, the water content in the coating fluid was 2.9% by weight. The results are shown in Table 2.

EXAMPLE 11

An electrophotographic photosensitive member was produced and evaluated in the same manner as in Example 5 except that, in place of the 97:3 mixed solvent of tetrahydrofuran and water, a 93:7 mixed solvent of tetrahydrofuran and water was used to prepare the charge generation layer coating fluid. Here, the water content in the coating fluid was 3.6% by weight. The results are shown in Table 2.

EXAMPLE 12

An electrophotographic photosensitive member was produced and evaluated in the same manner as in Example 5 except that 13 parts of water was further added to the charge generation layer coating fluid. Here, the water content in the coating fluid was 3.0% by weight. The results are shown in Table 2.

COMPARATIVE EXAMPLE 9

An electrophotographic photosensitive member was produced and evaluated in the same manner as in Example 11 except that the charge generation layer was formed to have a coating weight of 110 mg/m$^2$. Here, the water content in the coating fluid was 3.6% by weight. The results are shown in Table 2.

COMPARATIVE EXAMPLE 10

An electrophotographic photosensitive member was produced and evaluated in the same manner as in Example 12 except that the charge generation layer was formed to have a coating weight of 110 mg/m$^2$. Here, the water content in the coating fluid was 3.0% by weight. The results are shown in Table 2.

TABLE 2

| | A | | B | | | | Water content in | | | Ghost | |
|---|---|---|---|---|---|---|---|---|---|---|---|
| | Immediately after charging (−V) | 1 sec. after charging (−V) | Immediately after charging (−V) | 1 sec. after charging (−V) | A/B | Coating weight (mg/m$^2$) | coating fluid (wt. %) | Water/phthalocyanine (wt. %) | Sensitivity (mJ/m$^2$) | Initial stage (V) | After 1,000 sheets (V) |
| Example: | | | | | | | | | | | |
| 5 | 571 | 563 | 580 | 575 | 1.6 | 300 | 1.6 | 90 | 2.2 | 0 | 5 |
| 6 | 570 | 562 | 580 | 575 | 1.6 | 300 | 1.6 | 90 | 2.2 | 0 | 5 |
| 7 | 570 | 564 | 580 | 576 | 1.5 | 300 | 2.9 | 210 | 2.1 | 0 | 5 |
| 8 | 570 | 562 | 580 | 575 | 1.6 | 300 | 1.0 | 60 | 2.2 | 0 | 5 |
| 9 | 570 | 562 | 580 | 575 | 1.6 | 300 | 2.5 | 220 | 2.3 | 0 | 5 |
| 10 | 571 | 566 | 580 | 575 | 1.0 | 110 | 2.9 | 210 | 2.5 | 5 | 0 |
| 11 | 570 | 563 | 580 | 575 | 1.4 | 300 | 3.6 | 210 | 2.1 | 0 | 5 |
| 12 | 570 | 563 | 579 | 574 | 1.4 | 300 | 3.0 | 220 | 2.1 | 0 | 5 |
| Comparative Example: | | | | | | | | | | | |
| 6 | 570 | 558 | 580 | 576 | 3.1 | 300 | — | — | 2.5 | 15 | 25 |
| 7 | 569 | 556 | 579 | 575 | 3.3 | 300 | — | — | 2.5 | 15 | 25 |
| 8 | 570 | 562 | 579 | 575 | 2.0 | 300 | 0.6 | 30 | 2.5 | 5 | 15 |
| 9 | 569 | 565 | 579 | 574 | 0.8 | 110 | 3.6 | 210 | 2.4 | 10 | 0 |
| 10 | 570 | 566 | 580 | 575 | 0.8 | 110 | 3.0 | 220 | 2.4 | 10 | 0 |

What is claimed is:

1. An electrophotographic apparatus comprising:

an electrophotographic photosensitive member around which charging means for charging said electrophotographic photosensitive member, exposure means for exposing said electrophotographic photosensitive member to light to form a latent image thereon, developing means for developing the latent image formed on said electrophotographic photosensitive member with toner to produce a toner image, and transfer means for transferring the toner image to a transfer medium are provided in this order;

said electrophotographic apparatus being without charge elimination means between said transfer means and said charging means, wherein said electrophotographic photosensitive member comprises a support, a charge generation layer containing a phthalocyanine compound and a charge transport layer, and has a light-area dark attenuation rate A and a dark-area dark attenuation rate B both of which satisfy the following expression (1):

$$1.0 \leqq \text{light-area dark attenuation rate } A/\text{dark-area dark attenuation rate } B \leqq 1.7 \quad (1);$$

where $$A=(|a1-a2|)/a1$$

$$B=(|b1-b2|)/b1$$

and where a1=the surface potential of said electrophotographic photosensitive member immediately after charging of said electrophotographic photosensitive member by said charging means during a second image-forming operation of a first image-forming process, in which said electrophotographic photosensitive member had been charged by said charging means, and given whole surface exposure by said exposure means during a first image-forming operation of the first image-forming process;

a2=the surface potential of said electrophotographic photosensitive member after leaving said electrophotographic photosensitive member for one second in the dark immediately after charging of said electrophotographic photosensitive member during the second image-forming operation of the first image-forming process;

b1=the surface potential of said electrophotographic photosensitive member immediately after charging of said electrophotographic photosensitive member by said charging means during a second image-forming operation of a second image-forming process, in which said electrophotographic photosensitive member had been charged by said charging means, and kept unexposed during a first image-forming operation of the second image-forming process; and b2=the surface potential of said electrophotographic photosensitive member after leaving said electrophotographic photosensitive member for one second in the dark immediately after charging of said electrophotographic photosensitive member during the second image-forming operation of the second image-forming process, and wherein the phthalocyanine compound is oxytitanium phthalocyanine having strong peaks at Bragg's angles ($2\theta \pm 0.2°$) of 9.6° and 27.3° in CuKα characteristic X-ray diffraction.

2. An electrophotographic apparatus according to claim 1, wherein said charge generation layer has a coating weight of 300 mg/m$^2$ or less.

3. An electrophotographic apparatus according to claim 1, wherein said charge generation layer has a coating weight of from 100 mg/m$^2$ to 300 mg/m$^2$.

4. An electrophotographic apparatus according to claim 1, wherein said charge generation layer is formed using a charge generation layer coating fluid which contains water.

5. An electrophotographic apparatus according to claim 4, wherein the content of said water is from 1% by weight to less than 3% by weight based on the total weight of the charge generation layer coating fluid.

6. An electrophotographic apparatus according to claim 4, wherein the content of said water is from 1% by weight to less than 130% by weight based on the weight of the phthalocyanine compound.

7. An electrophotographic apparatus according to claim 6, wherein the content of said water is from 1% by weight to less than 100% by weight based on the weight of the phthalocyanine compound.

8. An electrophotographic apparatus according to claim 4, wherein said charge generation layer coating fluid further contains tetrahydrofuran and cyclohexanone.

9. A process cartridge which is detachably mountable to an electrophotographic apparatus comprising an electrophotographic photosensitive member around which charging means for charging said electrophotographic photosensitive member, exposure means for exposing the charged electrophotographic photosensitive member to light to form a latent image, developing means for developing the latent image with toner to produce a toner image, and transfer means for transferring the toner image to a transfer medium are provided in this order, said electrophotographic apparatus being without charge elimination means between the transfer means and the charging means, and said process cartridge comprising:

said electrophotographic photosensitive member comprising:

a support; and a charge generation layer provided on said support and containing a phthalocyanine compound and a charge transport layer, and having a light-area dark attenuation rate A and a dark-area dark attenuation rate B both of which satisfy the following expression (1):

$$1.0 \leqq \text{light-area dark attenuation rate } A/\text{dark-area dark attenuation rate } B \leqq 1.7 \quad (1);$$

where $$A=(|a1-a2|)/a1$$

$$B=(|b1-b2|)/b1$$

and where a1=the surface potential of said electrophotographic photosensitive member immediately after charging of said electrophotographic photosensitive member by said charging means during a second image-forming operation of a first image-forming process, in which said electrophotographic photosensitive member had been charged by said charging means, and given whole surface exposure by said exposure means during a first image forming operation of the first image-forming process;

a2=the surface potential of said electrophotographic photosensitive member after leaving said electrophotographic photosensitive member for one second in the dark immediately after charging of said electrophotographic photosensitive member during the second image-forming operation of the first image-forming process;

b1=the surface potential of said electrophotographic photosensitive member immediately after charging of said electrophotographic photosensitive member by said charging means during a second image-forming operation of a second image-forming process, in which said electrophotographic photosensitive member had been charged by said charging means, and kept unexposed during a first image-forming operation of the second image-forming process; and b2=the surface potential of said electrophotographic photosensitive member after leaving said electrophotographic photosensitive member for one second in the dark immediately after charging of said electrophotographic photosensitive member during the second image-forming operation of the second image-forming process, wherein the phthalocyanine compound is oxytitanium phthalocyanine having strong peaks at Bragg's angles (2θ±0.2°) of 9.6° and 27.3° in CuKα characteristic X-ray diffraction.

10. An electrophotographic photosensitive member for an electrophotographic apparatus comprising an electrophotographic photosensitive member around which charging means for charging said electrophotographic photosensitive member, exposure means for exposing said electrophotographic photosensitive member to light to form a latent image, developing means for developing the latent image with toner to form a toner image, and transfer means for transferring the toner image are provided in this order, and without charge elimination means between the transfer means and the charging means;

said electrophotographic photosensitive member comprising:

a support; and a charge generation layer provided on said support and containing a phthalocyanine compound and a charge transport layer, and having a light-area dark attenuation rate A and a dark-area dark attenuation rate B which satisfy the following expression (1):

$$1.0 \leqq \text{light-area dark attenuation rate } A/\text{dark-area dark attenuation rate } B \leqq 1.7 \quad (1);$$

where $$A=(|a1-a2|)/a1$$

$$B=(|b1-b2|)/b1$$

and where a1=the surface potential of said electrophotographic photosensitive member immediately after charging of said electrophotographic photosensitive member by the charging means during a second image-forming operation of a first image-forming process, in which said electrophotographic photosensitive member had been charged by the charging means, given whole surface exposure by the exposure means during a first image-forming operation of the first image-forming process;

a2=the surface potential of said electrophotographic photosensitive member after leaving said electrophotographic photosensitive member for one second in the dark immediately after charging of said electrophotographic photosensitive member during the second image-forming operation of the first image-forming process;

b1=the surface potential of said electrophotographic photosensitive member immediately after charging of said electrophotographic photosensitive member by the charging means during a second image-forming operation of a second image-forming process, in which said electrophotographic photosensitive member had been charged by the charging means, and kept unexposed during a first image-forming operation of the second image-forming process; and b2=the surface potential of said electrophotographic photosensitive member after leaving said electrophotographic photosensitive member for one second in the dark immediately after charging of said electrophotographic photosensitive member during the second image-forming operation of the second image-forming process, wherein the phthalocyanine compound is oxytitanium phthalocyanine having strong peaks at Bragg's angles (2θ±0.2°) of 9.6° and 27.3° in CuKα characteristic X-ray diffraction.

11. An electrophotographic photosensitive member for an electrophotographic apparatus without a charge elimination means of said electrophotographic photosensitive member, comprising a support, a charge generation layer containing a phthalocyanine compound and a charge transport layer, and having a light-area dark attenuation rate A and a dark-area dark attenuation rate B both of which satisfy the following expression (1):

$$1.0 \leqq \text{light-area dark attenuation rate } A/\text{dark-area dark attenuation rate } B \leqq 1.7 \quad (1);$$

where $$A=(|a1-a2|)/a1$$

$$B=(|b1-b2|)/b1$$

and where a1=the surface potential of said electrophotographic photosensitive member immediately after charging of said electrophotographic photosensitive member by charging means during a second image-forming operation of a first image-forming process, in which said electrophotographic photosensitive member had been charged by the charging means, and given whole surface exposure by exposure means during a first image-forming operation of the first image forming process;

a2=the surface potential of said electrophotographic photosensitive member after leaving said electrophotographic photosensitive member for one second in the dark immediately after charging of said electrophotographic photosensitive member during the second image-forming operation of the first image-forming process;

b1=the surface potential of said electrophotographic photosensitive member immediately after charging of said electrophotographic photosensitive member by the charging means during a second image-forming operation of a second image-forming process, in which said electrophotographic photosensitive member had been charged by the charging means, and kept unexposed during a first image-forming operation of the second image-forming process; and b2=the surface potential of said electrophotographic photosensitive member after leaving said electrophotographic photosensitive member for one second in the dark immediately after charging of said electrophotographic photosensitive member during the second image-forming operation of the second image-forming process, wherein the charge generation layer is formed by the process comprising the steps of:

providing a coating fluid comprising the phthalocyanine compound, an organic solvent and water, the content of the water being from 1% by weight to less than 3% by weight based on the total weight of the coating fluid; and coating the support with the coating fluid and forming the charge generation layer having a coating weight of 300 $mg/m^2$ or less.

* * * * *